US009401241B2

(12) United States Patent
Arceo et al.

(10) Patent No.: US 9,401,241 B2
(45) Date of Patent: Jul. 26, 2016

(54) SOLENOID COIL FOR HAZARDOUS LOCATIONS

(71) Applicant: Automatic Switch Company, Florham Park, NJ (US)

(72) Inventors: Emmanuel D. Arceo, Bloomfield, NJ (US); John J. Haller, Boonton, NJ (US); Vincent Cole, West New York, NJ (US); Eugene Gaw, Parsippany, NJ (US); William McDaniels, Branchburg, NJ (US)

(73) Assignee: AUTOMATIC SWITCH COMPANY, Florham Park, NJ (US)

( * ) Notice: Subject to any disclaimer, the term of this patent is extended or adjusted under 35 U.S.C. 154(b) by 0 days.

(21) Appl. No.: 14/264,776

(22) Filed: Apr. 29, 2014

(65) Prior Publication Data

US 2015/0310974 A1 Oct. 29, 2015

(51) Int. Cl.

| | |
|---|---|
| ***H01F 7/128*** | (2006.01) |
| ***H01F 7/08*** | (2006.01) |
| ***H01F 41/00*** | (2006.01) |
| *H01F 7/127* | (2006.01) |

(52) U.S. Cl.

CPC ..... *H01F 7/128* (2013.01); *H01F 7/081* (2013.01); *H01F 41/005* (2013.01); *H01F 7/127* (2013.01); *H01F 2007/083* (2013.01)

(58) Field of Classification Search

CPC . B29C 45/14639; H01F 41/127; H01F 41/10; H01F 41/04; H01F 7/081; H01F 7/127; H01F 7/128; H01F 7/1607; H01F 2007/083

See application file for complete search history.

(56) References Cited

U.S. PATENT DOCUMENTS

| | | | | | |
|---|---|---|---|---|---|
| 2,582,351 | A * | 1/1952 | Olson | 335/262 |
| 3,295,079 | A * | 12/1966 | Brown | 335/255 |
| 3,593,240 | A * | 7/1971 | Garczynski | 335/249 |
| 5,032,812 | A * | 7/1991 | Banick et al. | 335/17 |
| 5,050,840 | A * | 9/1991 | Kondo et al. | 251/129.15 |
| 6,409,144 | B1 * | 6/2002 | Inami | 251/129.15 |
| 6,459,348 | B1 * | 10/2002 | Birkelund | 335/270 |
| 2013/0056901 | A1 * | 3/2013 | Roedel et al. | 264/261 |

FOREIGN PATENT DOCUMENTS

GB 1183578 A * 3/1970

* cited by examiner

*Primary Examiner* — Mohamad Musleh
(74) *Attorney, Agent, or Firm* — Locke Lord LLP

(57) ABSTRACT

A solenoid coil assembly for hazardous environments comprises a solenoid coil and an enclosure entirely filled with encapsulation material. The encapsulation material leaves zero or almost zero volume in the enclosure for hazardous material to accumulate in any amount that could explode. This allows the solenoid coil assembly to be constructed without the usual industry standard flame paths. Additionally, the enclosure may be made of physically rigid and strong material such as metal or the like to better withstand harsh and corrosive conditions within hazardous environments without being explosion proof. The walls of such an enclosure need only have a moderate thickness and weight relative to enclosures that are explosion proof, as there is no meaningful risk of an explosion occurring within the enclosure. The combination of a rugged exterior and a zero-volume interior allows the solenoid coil assembly to reduce weight and cost while providing superior environmental protection.

6 Claims, 4 Drawing Sheets

SOLENOID COIL FOR HAZARDOUS LOCATIONS

FIELD OF THE INVENTION

The embodiments disclosed herein relate generally to solenoid coils that are capable of operating safely in hazardous areas and environments and particularly to a solenoid coil assembly that can operate in hazardous areas and environments at less weight and cost compared to existing solenoid coils.

BACKGROUND OF THE INVENTION

Hazardous environments, such as chemical processing plants, fuel storage tanks, and the like, require extensive precautions to prevent accidental ignition of highly flammable mixtures of liquids, gases, and other material. For example, solenoid coils are often used to operate valves within these environments and the flammable material may accumulate within the coil enclosure. When that happens, a spark from a mechanical and/or electrical contact in the coil can ignite the flammable material, leading to potentially disastrous results for personnel and property. It is therefore important for solenoid coils used in hazardous environments to be able to confine or control any explosions that may occur within the coil enclosure to prevent such explosions from reaching the external environment and igniting the flammable material at large. As well, the solenoid coil and the electrical connections therein need to be protected from dust and debris that may be present within the environment.

Several safety measures exist for rendering a solenoid coil explosion proof. One safety measure involves making the enclosure or housing around the solenoid coil (and the electrical connections thereto) strong enough to contain any explosions occurring inside the enclosure. This means the housing must be able to withstand the pressure generated by such explosions without physically deforming and releasing the hot gases from the explosion into the exterior environment. The ability to withstand an explosion requires the housing to be quite thick and heavy and typically made of metal, although some non-metallic materials have been used. The housing must also be constructed in a manner to prevent any explosion occurring in the interior of the housing from propagating through seams and joints to the exterior environment. This means any seam or joint in the housing, such as from flanged or threaded joints, must comply with OSHA (Occupational Safety and Health Administration) or other industry "flame path" requirements to cool the explosion gases as they escape from the interior of the housing, thus preventing them from igniting any flammable material in the exterior atmosphere. Such "flame paths" require the use of specialized components as well as precision machining of the enclosure, which may add significant costs to the solenoid coil.

Another safety measure involves using a total and void-less encapsulation of the solenoid coil. Typically, a suitable encapsulation material having the proper electrical insulating and resistive properties is used to fill the space between the solenoid coil and the enclosure. Such an encapsulation-filled enclosure is sometimes called a "zero-volume" enclosure because the encapsulation leaves no room within the enclosure for flammable material to accumulate in proximity to the electrical connections. As there is no flammable material that can explode, a high strength and heavy enclosure is not required. A drawback of this approach is the encapsulation material used, usually a thermoset or thermoplastic material, tends to have less resistance to physical abuse and harsh and corrosive conditions and therefore may break down more quickly in many hazardous environments, thus compromising the integrity of the encapsulation.

Accordingly, a need exists for a solenoid coil for hazardous environments that provides improved protection from explosions and is more physically rugged at less weight and cost relative to existing solutions.

SUMMARY OF THE INVENTION

The embodiments disclosed herein relate to a solenoid coil assembly for hazardous environments that provides improved protection from explosions and is more physically rugged at less weight and cost relative to existing solutions. The disclosed solenoid coil assembly comprises a solenoid coil housed within a protective enclosure or casing that may be entirely filled with encapsulation material, such as a transfer molded thermoset or an injection molded thermoplastic. The encapsulation material takes up all or almost all of the space within the enclosure, leaving zero or almost zero volume in the enclosure for flammable material from the external environment to accumulate in any amount that could explode. The absence of any appreciable amount of flammable material allows the solenoid coil assembly to be constructed without the usual industry standard flame paths. Additionally, the enclosure may be may be made of a physically strong and rigid material such as metal or the like that can withstand harsh and/or corrosive conditions within hazardous environments, but need not be explosion proof because there is no meaningful risk of an explosion occurring within the enclosure. This allows the walls of such an enclosure to have only a moderate thickness and weight relative to enclosures that are required to be explosion proof. The combination of a physically rigid exterior and a zero-volume interior allows the solenoid coil assembly to reduce size, weight, and cost while providing superior environmental protection, more physical strength, and better gas group ratings.

In general in one aspect, the disclosed embodiments relate to a solenoid coil assembly configured to operate a valve assembly in a hazardous environment. The solenoid coil assembly comprises, among other things, a solenoid coil and a protective housing enclosing the solenoid coil. The protective housing has a plurality of walls, with at least two walls having openings for receiving the valve assembly. Encapsulation material is disposed within the protective housing and surrounds the solenoid coil, the encapsulation material filling the protective housing and preventing hazardous material from the hazardous environment from accumulating within the protective housing. At least one wall of the protective housing is made of a corrosion resistant material and has a thickness that renders the protective housing non-compliant with one or more industry strength requirements for solenoid coil assemblies in the hazardous environment.

In general, in another aspect, the disclosed embodiments relate to a solenoid coil assembly configured to operate a valve assembly in a hazardous environment. The solenoid coil assembly comprises, among other things, a yoke having a base portion connected to two flange portions, the base portion and the two flange portions having a generally U-shaped profile. A bobbin is mounted to the yoke, the bobbin having a tubular main body connected to a top plate and a bottom plate and configured to hold a coil of wire thereon. The solenoid coil assembly further comprises a protective housing enclosing the yoke and the bobbin, the protective housing having a plurality of generally rectangular side walls, a generally rectangular top wall, and a generally rectangular bottom wall, each of the generally rectangular top wall and the generally rectangular bottom wall having an annular opening for receiving the valve assembly. Encapsulation material is disposed within the protective housing and surrounds the yoke and the bobbin, the encapsulation material filling the protective housing and preventing hazardous material from the hazardous environment from accumulating within the protective housing. At least one wall of the protective housing is made of a corrosion resistant material and has a thickness that renders the protective housing non-compliant with at least one industry strength requirement for solenoid coil assemblies in the hazardous environment.

In general, in yet another aspect, the disclosed embodiments relate to a method for preparing a solenoid coil assembly for operating a valve assembly in a hazardous environment. The method comprises, among other things, mounting a bobbin to a yoke and enclosing the bobbin and the yoke within a protective housing, the protective housing having a wire conduit integrally formed thereon. The method further comprises attaching a conduit sleeve to the wire conduit and injecting an encapsulation material into the protective housing such that the encapsulation material fills the protective housing and the wire sleeve to form a zero-volume enclosure. The zero-volume enclosure prevents hazardous material from the hazardous environment from accumulating within the protective housing.

BRIEF DESCRIPTION OF THE DRAWINGS

The foregoing and other advantages of the disclosed embodiments will become apparent upon reading the following detailed description and upon reference to the drawings, wherein.

DETAILED DESCRIPTION OF THE DISCLOSED EMBODIMENTS

As an initial matter, it will be appreciated that the development of an actual, real commercial application incorporating aspects of the disclosed embodiments will require many implementation specific decisions to achieve the developer's ultimate goal for the commercial embodiment. Such implementation specific decisions may include, and likely are not limited to, compliance with system related, business related, government related and other constraints, which may vary by specific implementation, location and from time to time. While a developer's efforts might be complex and time consuming in an absolute sense, such efforts would nevertheless be a routine undertaking for those of skill in this art having the benefit of this disclosure.

It should also be understood that the embodiments disclosed and taught herein are susceptible to numerous and various modifications and alternative forms. Thus, the use of a singular term, such as, but not limited to, "a" and the like, is not intended as limiting of the number of items. Similarly, any relational terms, such as, but not limited to, "top," "bottom," "left," "right," "upper," "lower," "down," "up," "side," and the like, used in the written description are for clarity in specific reference to the drawings and are not intended to limit the scope of the invention.

The disclosed embodiments relate to a solenoid coil assembly for hazardous environments that provides improved protection from explosions and is more physically rugged at less weight and cost. Among other things, the disclosed solenoid coil assembly combines a physically rigid exterior and a zero-volume interior, resulting in superior environmental protection, more physical strength, a compact design, and better gas group ratings, while at the same time saving weight and cost compared to existing solutions.

Figure 1:
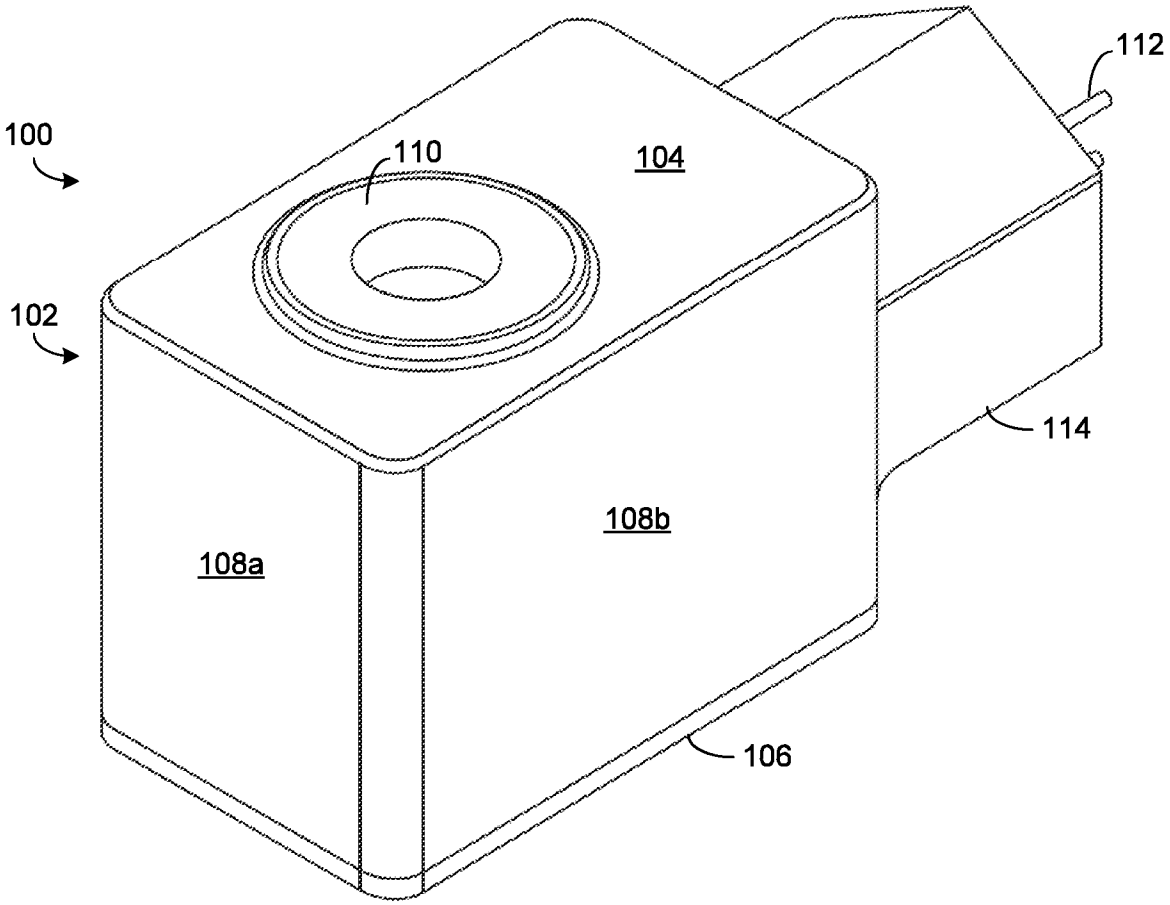
FIG. 1 is a perspective view of a solenoid coil assembly according to the disclosed embodiments.

Turning now to FIG. 1, a perspective view of a solenoid coil assembly 100 is shown according to the embodiments disclosed herein. As can be seen in this view, the solenoid coil assembly 100 includes a protective enclosure 102 having a generally rectangular top wall or cover 104, a generally rectangular bottom wall or cover 106, and generally rectangular side walls 108*a*, 108*b*, 108*c*, and 108*d* so the enclosure 102 resembles a rectangular prism when assembled. A raised annular pad 110 is formed or other otherwise provided on the top cover 104 for receiving washers, nuts, and the like (not expressly shown) when connecting the solenoid coil assembly 100 to a valve (not expressly shown). Lead wires 112 enter the enclosure 102 through a wire conduit 114 to electrically connect the wire coil inside the enclosure 102 to an electrical system. To reduce cost, the wire conduit 114 may be integrated as a single piece with the enclosure 102 in some embodiments so no additional brazing or welding is needed to mount or otherwise attach the wire conduit 114 to the enclosure 102.

In accordance with the disclosed embodiments, the enclosure 102 may be completely filled with encapsulation material, such as a transfer molded thermoset, an injection molded thermoplastic, or the like. The encapsulation material takes up all or almost all of the volume within the enclosure 102 so there is zero or almost zero volume in the enclosure 102 for flammable material from the external environment to accumulate in any appreciable amount (i.e., an amount that could result in an explosion). The absence of any significant amount of flammable material allows the solenoid coil assembly 100 to be constructed without flame paths or other usual OSHA or industry standard requirements. As well, the absence of any meaningful amount of flammable material allows the walls of the enclosure 102 to be lighter and less thick compared to enclosures that are explosion proof, resulting in substantial cost savings.

Figure 2:
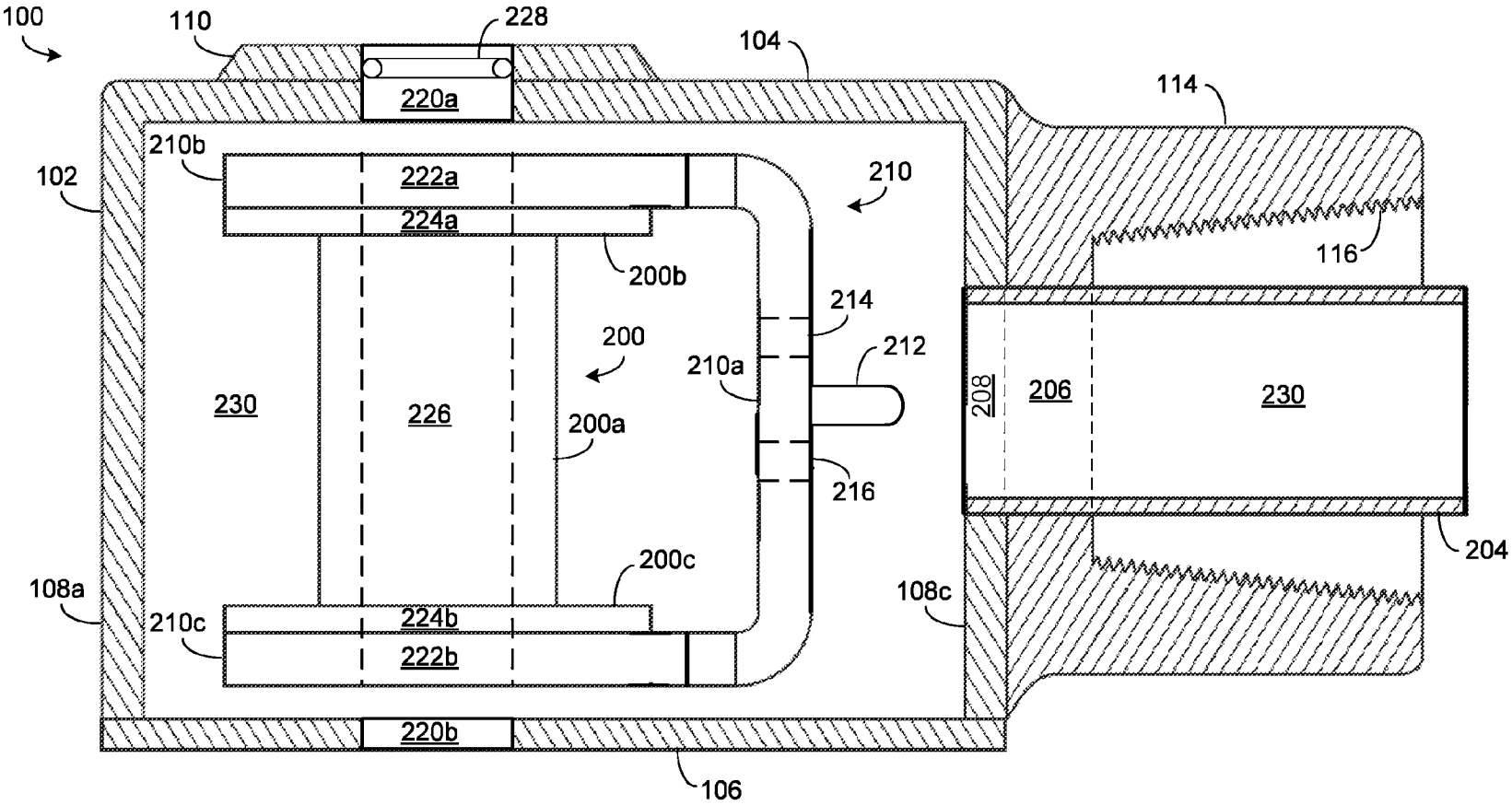
FIG. 2 is a partial cross-sectional view of a solenoid coil assembly according to the disclosed embodiments.

FIG. 2 illustrates a cross-sectional view of the enclosure 102 according to an embodiment disclosed herein. As this view shows, the enclosure 102 of the solenoid coil assembly 100 houses a bobbin 200 having a generally tubular body 200*a* around which wire may be wound to form a coil (not expressly shown). A generally circular top plate 200*b* and a generally circular bottom plate 200*c* are attached to the two ends of the tubular body 200*a* to help retain the coil of wire on the tubular body 200*a*. The top and bottom plates 200*b* & 200*c* also allow the bobbin 200 to be mounted to a yoke 210 that, among other things, provides structural support for the bobbin 200. In the embodiment shown here, the yoke 210 has a generally U-shaped profile with a base portion 210*a* forming the base of the U shape and two flange portions 210*b* & 210*c* forming the two sides of the U shape. The two flange portions 210*b* & 210*c* forming the two sides of the U shape may then be attached to the top and bottom plates 200*b* & 200*c* of the bobbin 200, respectively, to connect the yoke 210 to the bobbin 200. In some embodiments, a ground terminal 212 may also be provided for the yoke 210, for example, on the base portion 210*a*, to provide a ground connection. As a cost savings, the ground terminal 212 may be integrated with the yoke 210 in some embodiments so no additional attachment means is needed.

In some embodiments, a tubular conduit sleeve 204 may be provided in the wire conduit 114 for receiving the lead wires 112 (see FIG. 1). The conduit sleeve 204 may be press fitted to the enclosure 102 via openings 206 and 208 in the wire conduit 114 and a side wall 108*c* of the enclosure 102, respectively. Internal threads 116 on the wire conduit 114 allow it to be connected to a similarly threaded external component. Openings 212 and 214 formed in the base portion 210*a* of the yoke 210 allow the lead wires 112 from the conduit sleeve 204 to pass through the base portion of the yoke 210 for connection to the coil of wire on the bobbin 200.

Connecting the solenoid coil assembly 100 to a valve entails passing a valve core assembly (not expressly shown) through a passageway in the solenoid coil assembly 100. The passageway is formed by openings 220*a* & 220*b* in the top and bottom covers 104 & 106 of the enclosure 102, openings 222*a* & 222*b* in the two flange portions 210*b* & 210*c* of the yoke 210, openings 224*a* & 224*b* in the top and bottom plates 200*b* & 200*c* of the bobbin 200, and a passage 226 in the tubular body 200*a* of the bobbin 200. In some embodiments, an O-ring 228 may be disposed in one or both of the openings 220*a* & 220*b* in the top and bottom covers 104 & 106 of the enclosure 102 to help provide a liquid tight and airtight seal for the solenoid coil assembly 100.

In accordance with the disclosed embodiments, the volume in the enclosure 102 and the volume in the conduit sleeve 204 are filled with encapsulation material, indicated generally at 230, so there is zero or almost zero room in the enclosure 102 and the volume in the conduit sleeve 204 that is not otherwise occupied by components or lead wires (see FIG. 1). The result is a "zero-volume" enclosure 102 in which no appreciable amount of flammable material from the external environment may accumulate. This obviates the need for the solenoid coil assembly 100 to be specially designed to withstand explosions. As such, the bobbin 200, yoke 210, and other components used in the solenoid coil assembly 100 may be standard components or components not specifically designed for hazardous environments in many cases, despite their intended use in hazardous environments. For example, the press fit between the tubular conduit sleeve 204 and the enclosure 102 and other seams and joints within the solenoid coil assembly 100 need not, and actually do not in some cases, comply with industry flame path requirements, which allows them to be machined with less precision compared to enclosures that are required to meet industry flame path requirements. Similarly, the side walls and top and bottom covers of the enclosure 102 need not, and actually do not in some cases, meet industry explosion proof requirements, which allows them to have relatively moderate thickness compared to enclosures that are required to meet industry explosion proof requirements. This gives the solenoid coil assembly 100 improved environmental protection, greater physical strength, a more compact design, and better gas group ratings, while at the same time reducing weight and cost compared to existing solenoid coil assemblies.

Figure 3:
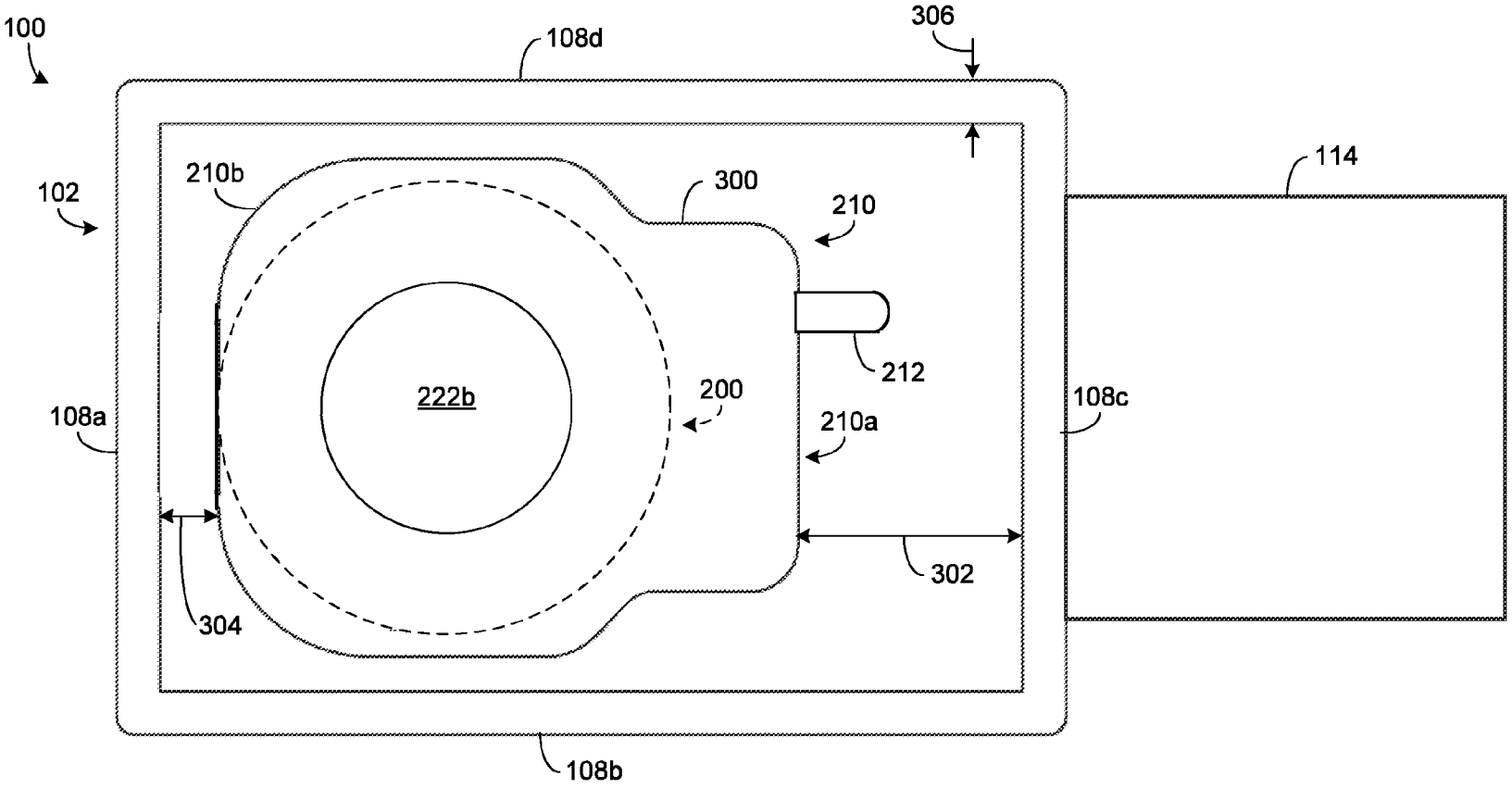
FIG. 3 is a plan view of a solenoid coil assembly according to the disclosed embodiments.

Referring now to FIG. 3, a plan view of the solenoid coil assembly 100 is shown with the top cover 104 removed from the enclosure 102 for easy viewing. As can be seen here, one or both of the two flange portions 210*b* & 210*c* of the yoke 210 may narrow to a neck portion 300 extending toward the base portion of the yoke 210 in some embodiments. As can also be seen, the distance between the base portion of the yoke 210 and the corresponding side wall 108*c* of the enclosure 102 may be about ⅜ of an inch (within ±10 percent) in some embodiments, as indicated at 302. The distance between the other side walls 108*a*, 108*b*, and 108*d* of the enclosure 102 and the two flange portions 210*b* & 210*c* may be about 1 millimeter (within ±10 percent) in some embodiments, as indicated at 304. The side walls may have a thickness, for example about 0.06 inches (within ±10 percent), as indicated at 306, that is sufficient to provide rugged protection without necessarily being explosion proof. Likewise, the top and bottom covers 104 and 106 may have a thickness of about 0.06 inches in some embodiments. These side walls and the top and bottom covers are preferably made of a high strength and corrosion resistant material such as Grade 316L stainless steel or the like. The enclosure 102 itself may be an investment cast enclosure 102 such that no additional material needs to be hollowed out to form the enclosure 102. Other manufacturing techniques, such as 3-D printing, may also be used to produce the enclosure 102 and other components discussed herein without the parting from the scope of the disclosed embodiments. Regardless of the particular manufacturing technique used, it should be clear to those having ordinary skill in the art that the foregoing embodiments allow the solenoid coil assembly 100 to provide improved protection for hazardous environments at less weight and cost relative to existing solutions.

Figure 4:
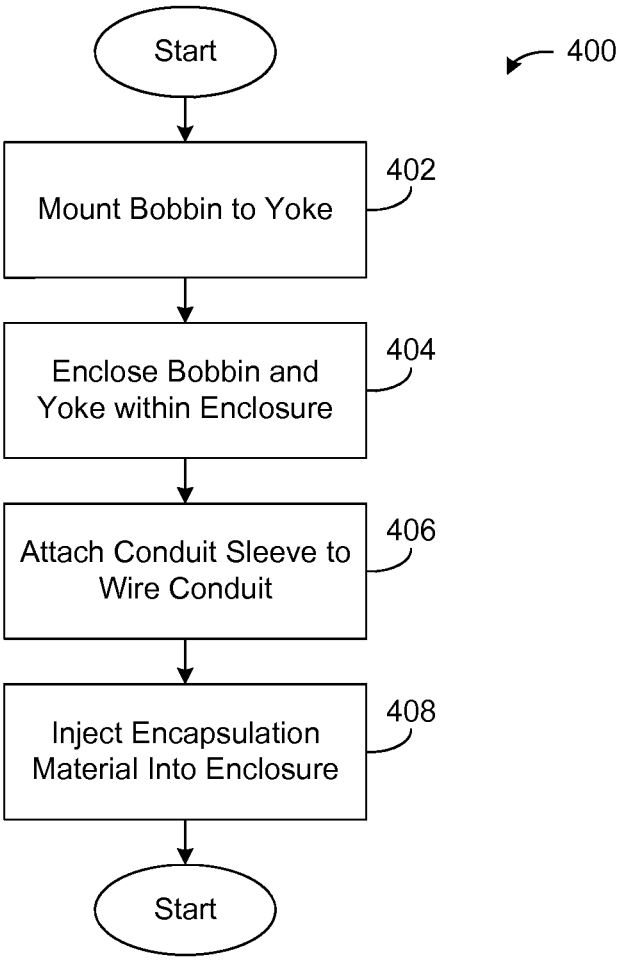
FIG. 4 is a flowchart of a method of assembling solenoid coil assembly according to the disclosed embodiments.

General guidelines for assembling or otherwise preparing the solenoid coil assembly 100 according to the embodiments disclosed herein are illustrated in FIG. 4 in the form of a flow chart 400. As an initial matter, it should be understood that although the flow chart 400 of FIG. 4 shows a number of discrete blocks, one or more of these blocks may be divided into several constituent blocks, and two or more of these blocks may be combined into a single block, without departing from the scope of the disclosed embodiments. In addition, although the blocks are shown in a particular sequence, it should be understood that one or more blocks may be taken outside of the sequence shown, or omitted altogether, without departing from the scope of the disclosed embodiments.

As FIG. 4 shows, assembling or preparing the solenoid coil assembly 100 generally begins at block 402, where a bobbin having a coil of wire wound thereon is mounted to the yoke of the solenoid coil assembly. Next, at block 404, the bobbin and yoke are placed inside and then enclosed within the enclosure of the solenoid coil assembly. At block 406, the conduit sleeve is attached (e.g., press fitted) to the enclosure, specifically to the integrated wire conduit of the enclosure. Then, at block 408, an encapsulant or encapsulation material is injected into the enclosure, for example, through the opening normally covered by the bottom cover 106. The encapsulation material is preferably injected in a liquid or fluid state, and at a rate, pressure, and/or temperature such that the material takes up all or almost all of the space within the enclosure, leaving zero or almost zero volume in the enclosure for flammable material from the external environment to accumulate in any amount that could explode.

While particular aspects, implementations, and applications of the present disclosure have been illustrated and described, it is to be understood that the present disclosure is not limited to the precise construction and compositions disclosed herein. For example, instead of the solenoid coil assembly resembling a rectangular shaped prism, in some embodiments, the solenoid coil assembly may have a somewhat cylindrical shape, or the like. Therefore, various modifications, changes, and variations may be apparent from the foregoing descriptions without departing from the spirit and scope of the disclosed embodiments as defined in the appended claims.

What is claimed is:

1. A solenoid coil assembly configured to operate a valve assembly in a hazardous environment, comprising:

a yoke having a base portion connected to two flange portions, the base portion and the two flange portions having a generally U-shaped profile;

a bobbin mounted to the yoke, the bobbin having a tubular main body connected to a top plate and a bottom plate and configured to hold a coil of wire thereon;

a protective housing enclosing the yoke and the bobbin, the protective housing having a plurality of generally rectangular side walls, a generally rectangular top wall, and a generally rectangular bottom wall, each of the generally rectangular top wall and the generally rectangular bottom wall having an annular opening therein for receiving the valve assembly; and encapsulation material disposed within the protective housing and surrounding the yoke and the bobbin, the encapsulation material filling the protective housing and preventing hazardous material from the hazardous environment from accumulating within the protective housing;

wherein the protective housing is made of metal.

2. The solenoid coil assembly of claim 1, further comprising a wire conduit integrally formed with the protective housing.

3. The solenoid coil assembly of claim 2, further comprising a conduit sleeve press fitted into the wire conduit and the protective housing.

4. The solenoid coil assembly of claim 1, further comprising an O-ring disposed in one or more of the annular openings in the generally rectangular top wall and the generally rectangular bottom wall.

5. The solenoid coil assembly of claim 1, further comprising a grounding terminal integrally formed with the yoke.

6. The solenoid coil assembly of claim 1, wherein the hazardous environment is one of a chemical processing plant or a fuel storage tank and the bobbin and the yoke have not been specifically designed for use in the chemical processing plant or the fuel storage tank.

* * * * *